US008707636B1

(12) United States Patent
Toson et al.

(10) Patent No.: US 8,707,636 B1
(45) Date of Patent: Apr. 29, 2014

(54) MEMORIAL FOUNDATION SYSTEM AND INSTALLATION METHOD

(71) Applicant: The Tribute Companies, Inc., Hartland, WI (US)

(72) Inventors: William R. Toson, Oconomowoc, WI (US); Tim Hentges, Delafield, WI (US); Dean Wardlow, Forreston, IL (US); Doug Engel, Freeland, MI (US); Clyde Rupnow, Watertown, WI (US)

(73) Assignee: The Tribute Companies, Inc., Hartland, WI (US)

( * ) Notice: Subject to any disclaimer, the term of this patent is extended or adjusted under 35 U.S.C. 154(b) by 50 days.

(21) Appl. No.: 13/649,761

(22) Filed: Oct. 11, 2012

(51) Int. Cl.
*E04H 13/00* (2006.01)

(52) U.S. Cl.
USPC ..... 52/103; 52/155; 52/169.9; 52/741.11; 40/124.5

(58) Field of Classification Search
CPC ..... E04H 13/003; E04H 13/00; E04H 12/22; G04C 15/04
USPC ..... 52/103, 128, 133, 169.9, 170, 155, 157, 52/741.11; 40/124.5
See application file for complete search history.

(56) References Cited

U.S. PATENT DOCUMENTS

| | | | | |
|---|---|---|---|---|
| 2,095,290 | A * | 10/1937 | Roy | 52/38 |
| 3,581,452 | A * | 6/1971 | Jalbert | 52/133 |
| 5,546,710 | A * | 8/1996 | Barry | 52/104 |
| 5,647,108 | A * | 7/1997 | Crook | 27/1 |
| 6,076,292 | A | 6/2000 | Kawa | |
| 7,144,201 | B2 | 12/2006 | DeArmond, Jr. | |
| 7,637,061 | B2 | 12/2009 | Murphy et al. | |
| 8,561,363 | B2 * | 10/2013 | DeArmond, Jr. | 52/170 |
| 2007/0113431 | A1 * | 5/2007 | Cooper | 40/124.5 |

* cited by examiner

*Primary Examiner* — William Gilbert
(74) *Attorney, Agent, or Firm* — Michael Best & Friedrich LLP

(57) ABSTRACT

A memorial foundation system includes a pair of vertical supports having screw threads on their bottom ends and first attachment structure at their upper ends. Support plates corresponding to the vertical supports have respective second attachment structures configured to mate with the first attachment structures. A block has a first end supported by one of the pair of support plates and one of the pair of vertical supports and a second opposite end supported by the other of the pair of support plates and the other of the pair of vertical supports. The block includes a plurality of pockets in a row, each of the pockets open to an upper side. Each of a plurality of markers is configured to be received by a corresponding one of the plurality of pockets in the block to arrange the plurality of markers in an aligned row with even height.

20 Claims, 8 Drawing Sheets

MEMORIAL FOUNDATION SYSTEM AND INSTALLATION METHOD

BACKGROUND

The present invention relates to memorial foundations used, for example in veteran's cemeteries, to ensure proper uniform placement of memorials in the ground. Known systems are typically labor intensive and subject to undesirable variability in placement of memorials, particularly over time, whereby significant maintenance or re-work must be carried out due to ground settling, even if installed according to manufacturer specifications.

SUMMARY

In one aspect, the invention provides a memorial foundation system. A pair of vertical supports each has a screw thread on at least a portion extending from a bottom end thereof, and each of the pair of vertical supports further has a head portion with a first attachment structure at an upper end. A pair of support plates correspond to the pair of vertical supports, and each of the pair of support plates has a second attachment structure configured to mate with the first attachment structure. A first block has a first end supported by one of the pair of support plates and one of the pair of vertical supports, and a second opposite end supported by the other of the pair of support plates and the other of the pair of vertical supports. The first block includes a plurality of pockets arranged in a row, each of the plurality of pockets being open to an upper side of the first block. Each of a first plurality of markers is configured to be received by a corresponding one of the plurality of pockets in the block to arrange the first plurality of markers in an aligned row with even height.

In another aspect, the invention provides a memorial foundation system including first, second, and third supports, each having a screw thread on at least a portion extending from a bottom end thereof for driving into the ground and further having at least one plate positioned at an upper end thereof. First and second blocks each have a plurality of pockets arranged in a row, each of the plurality of pockets being open to an upper side of the respective block. The first block is supported by the first and second supports, and the second block is supported by the second and third supports. A bottom surface of each of the first and second blocks and a top surface of the at least one plate of the second support are provided with interlocking engagement structures to align the first and second blocks. Each of a plurality of markers is configured to be received by a corresponding one of the plurality of pockets of the first and second blocks to arrange the plurality of markers in both the first and second blocks in an aligned row with even height.

In yet another aspect, the invention provides a method of installing a memorial foundation system. A trench is formed in the ground. First and second spaced apart vertical support rods are driven into the ground within the trench. At least one plate is provided atop the first vertical support rod, the at least one plate arranged to present a first upwardly-facing engagement structure, and at least one plate is provided atop the second vertical support rod, the at least one plate arranged to present a second upwardly-facing engagement structure. The first and second engagement structures are aligned. A first block is provided having a plurality of pockets arranged in a row, each of the plurality of pockets being open to an upper side of the first block. The first block is placed onto the at least one plate on the first vertical support rod and onto the at least one plate on the second vertical support rod such that at least one complementary engagement structure provided on a bottom surface of the first block engages the first and second engagement structures. A plurality of markers is installed into corresponding ones of the plurality of pockets in the first block to form an aligned row of even height.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
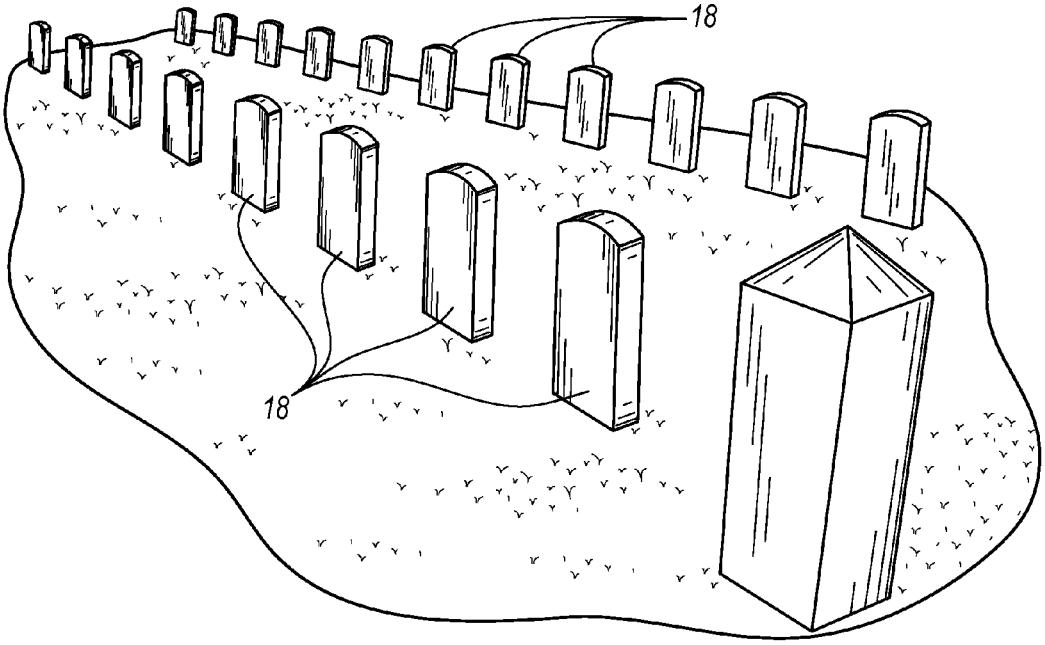
FIG. 1 is a perspective of a cemetery landscape with rows of aligned headstones.

FIG. 1 illustrates a landscape with a number of memorial markers 18 (e.g., headstones) arranged in aligned rows and mounted in the ground with a memorial foundation system 20 described in further detail below. The memorial foundation system 20 can be used for veterans cemeteries where large numbers of similar memorial markers 18 are provided in rows in the ground. However, the memorial foundation system 20 can be used for other types of cemeteries, and even for mounting memorial markers of other types entirely. As described in detail below, the memorial foundation system 20 is particularly adapted for simplified, long-lasting installation of memorial markers 18 with accurate alignment that is not subject to frequent misalignment and required restoration due to ground settling.

Figure 2:
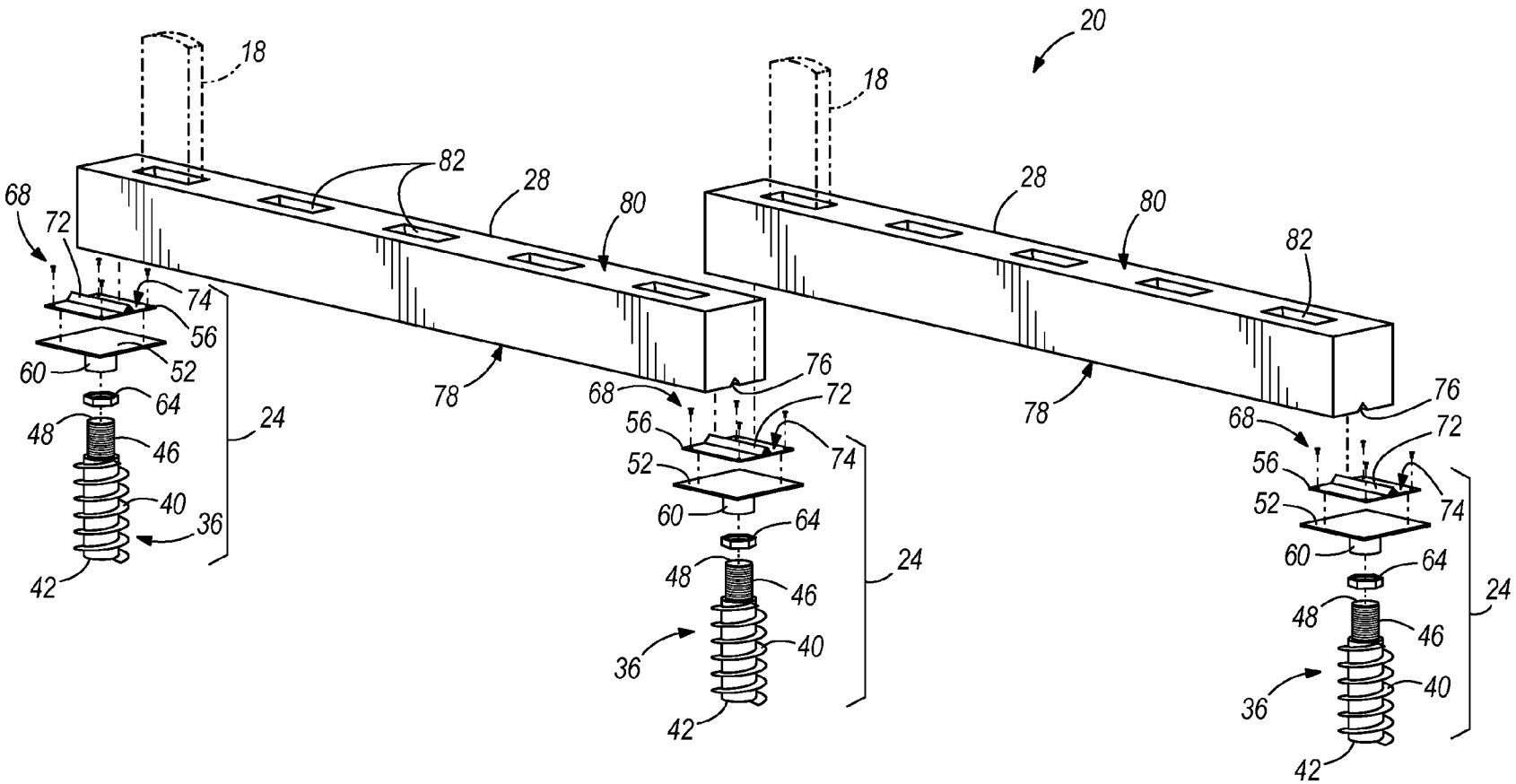
FIG. 2 is an exploded assembly view of a memorial foundation system according to one aspect of the invention.
Figure 3:
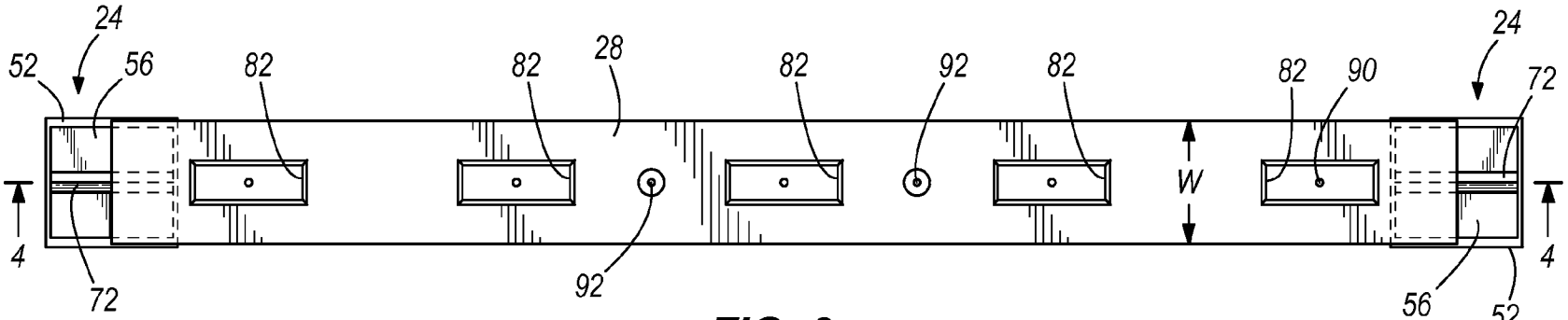
FIG. 3 is a top view of the memorial foundation system of FIG. 2.
Figure 4:
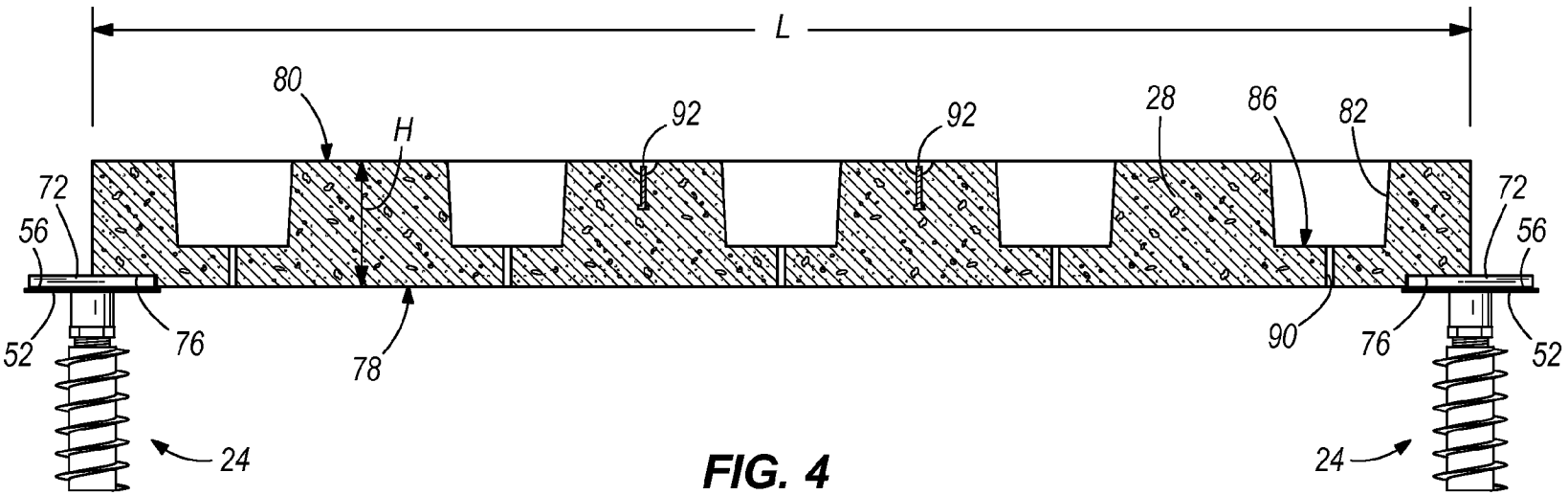
FIG. 4 is a longitudinal cross-section of the memorial foundation system, taken along line 4-4 of FIG. 3.
Figure 4A:
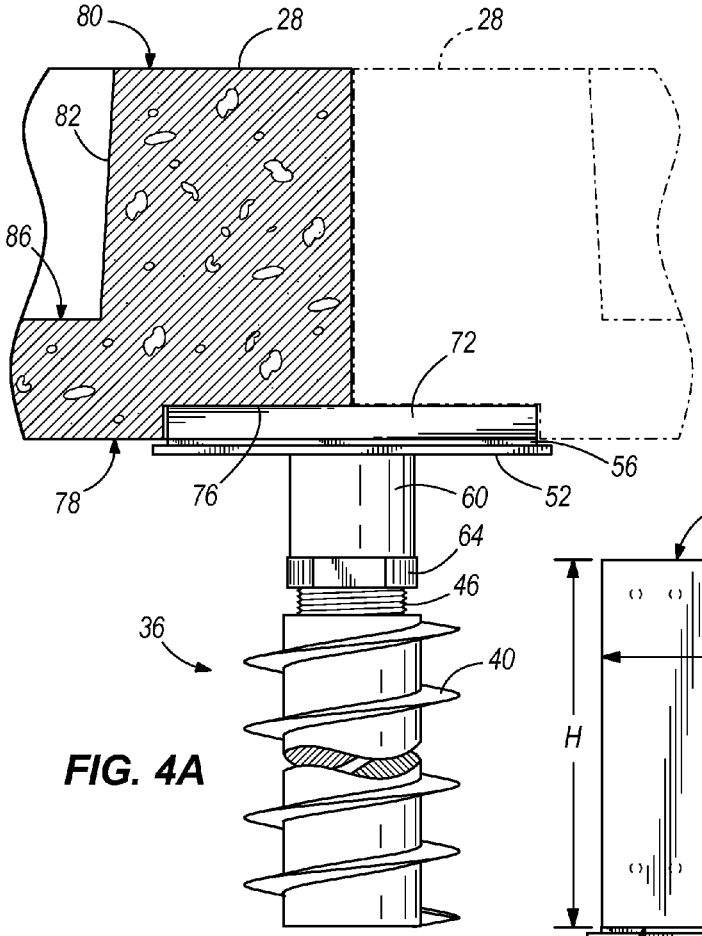
FIG. 4A is a detail of an end portion of the memorial foundation system cross-section of FIG. 4.
Figure 5:
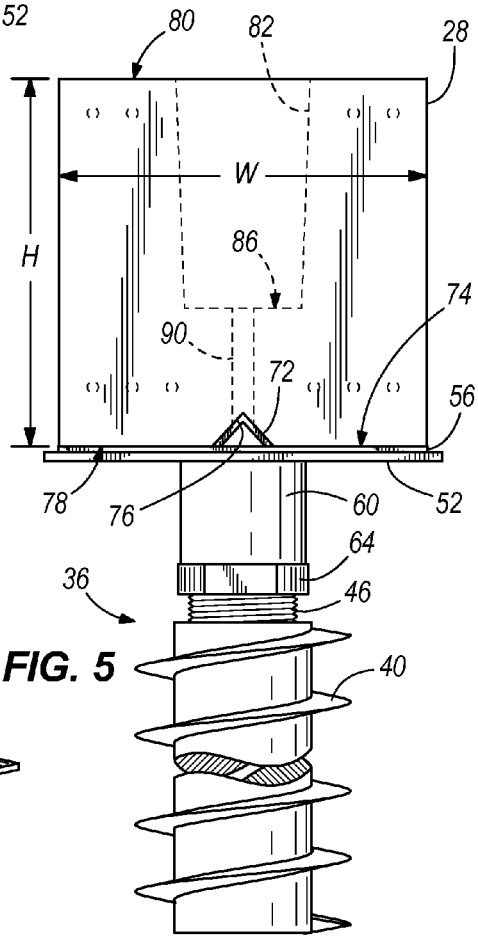
FIG. 5 is an end view of the memorial foundation system illustrating an alignment interface.
Figure 6:
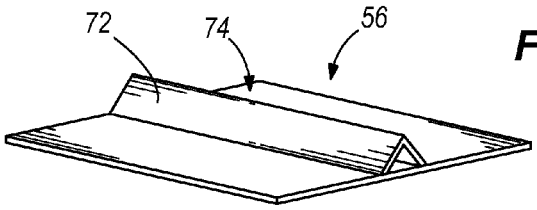
FIG. 6 is a perspective view of an alignment plate.

With reference to FIG. 2, the memorial foundation system 20 includes a number of support assemblies 24, a number of blocks 28 supported by the support assemblies 24, and a number of memorial markers 18 receivable into the blocks 28. The illustrated memorial foundation system 20 includes three support assemblies 24, but the memorial foundation system 20 can include one or more than two blocks 28 supported by two or more support assemblies 24, and the number of memorial markers 18 per block 28 may be more or less than five as shown.

Each of the support assemblies 24 includes a vertical support 36, such as a vertically-oriented rod or foundation pier, that is drivable into the ground and securable therein. For example, each vertical support 36 can include an auger-type screw portion 40 on at least a portion extending from a bottom end 42 thereof. Each of the vertical supports 36 also has a head portion with a first attachment structure 46 at an upper end 48, opposite the bottom end 42. The first attachment structure 46 can be a male screw thread.

At least one plate is coupled to each vertical support 36 as an interface between the vertical support 36 and at least one of the blocks 28. In the illustrated construction, both a support plate 52 and an alignment plate 56 are provided at the upper end 48 of each vertical support 36. Each support plate 52 is provided with a second attachment structure 60 for coupling to the first attachment structure 46 of the corresponding vertical support 36. The second attachment structure 60 can be a female screw thread configured to adjustably receive the male screw thread of the first attachment structure 46. Whether by screw threads or another type of structure, the first and second attachment structures 46, 60 can provide a height-adjustable interface, which is operable during an installation procedure to ensure that the support plates 52 atop a corresponding plurality of vertical supports 36 are provided at even height. In one construction, the second attachment structure 60 includes a hollow cylindrical extension secured with and protruded from a bottom side of the support plate 52. A locking device can be provided on the height-adjustable interface, for example a jam nut 64, to secure the height of the support plate 52 on the vertical support 36 once properly adjusted.

The alignment plates 56 are securable to the top of the respective support plates 52 to provide a resting surface for the block(s) 28. For example, a plurality of threaded fasteners 68 may be used to secure each alignment plate 56 to the corresponding support plate 52. In one construction, both the support plates 52 and the alignment plates 56 are constructed of sheet metal, and the fasteners 68 are self-tapping screws. However, the plates 52, 56 may have other constructions and may be coupled in different ways. Alternatively, the features of the support plate 52 and the alignment plate 56 can be provided together in a single, integral plate, or provided as a sub-assembly with an adjustable connection therebetween. An engagement structure 72 is provided on an upper surface 74 of each alignment plate 56 that is engageable with a complementary engagement structure 76 provided on a bottom surface 78 of the block(s) 28. The engagement structures 72 of the alignment plates 56 and the complementary engagement structures 76 of the block(s) can include a V-shaped projection and a complementary V-shaped notch. In the illustrated construction, the V-shaped projection is provided on the alignment plates 56 and the V-shaped notch is provided on the block(s). The engagement structure 76 of each block 28 can extend the full length of the block 28, or alternatively, only at prescribed locations such as the portions adjacent the two ends. Likewise, the engagement structure 72 of the alignment plates 56 can be provided as a single, unitary feature or a plurality of features. As described in further detail below, the interface of the engagement structures 72, 76 ensures alignment between the ends of two blocks 28 that rest side-by-side on a single alignment plate 56, and furthermore, ensures alignment between these and other end-to-end blocks 28 when numerous alignment plates 56 are all installed to be aligned with each other (as opposed to being installed solely in register with features of the respective support plates 52). As mentioned above, other plate configurations are contemplated. For example, a single plate having a fixed or adjustably-mounted engagement feature 72 may be provided. It should also be appreciated that the engagement structures 72 can take on any number of different forms that ensure orientation control when mated with the complementary engagement structure(s) 76 of the block 28.

Opposite the bottom surface 78 of each block 28 which is supported on the support assemblies 24, a top surface 80 of each block 28 includes a plurality of openings or pockets 82 configured to receive the individual memorial markers 18. Each pocket 82 has a bottom surface 86 that is substantially horizontal and parallel with the bottom and top surfaces 78, 80. The size of each pocket 82 expands slightly from the bottom pocket surface 86 toward the top surface 80 of the block 28. An aperture 90, substantially smaller than the area of the bottom pocket surface 86, can be provided to allow fluid communication for drainage between the pocket 82 and the bottom surface 78 of the block 28. The pockets 82 are oversized with respect to the memorial markers 18 to allow backfilling and fore-aft tilt control of the memorial markers 18 within the pockets 82. The blocks 28 are steel-reinforced concrete in some constructions, and may be formed with integral lifting pins 92 for handling with a crane or other device. Each block 28 has a length L, a height H, and width W.

Figure 7:
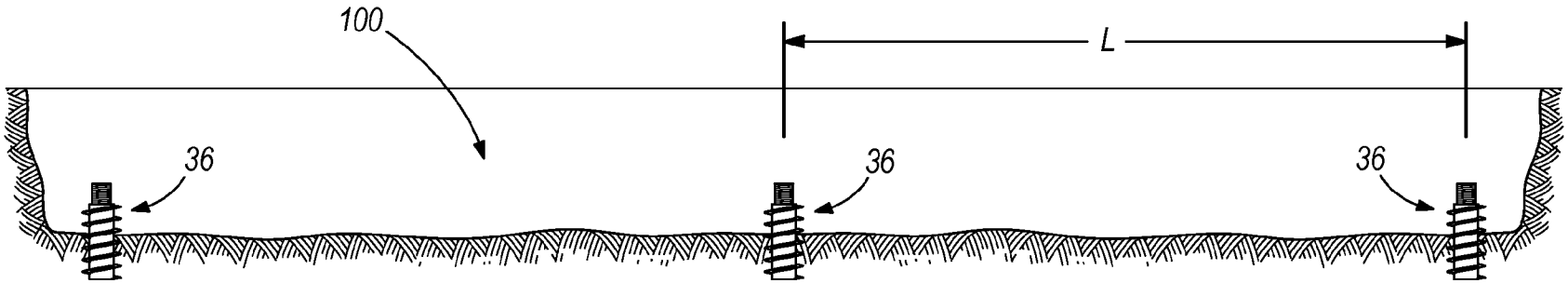
FIG. 7 illustrates a method step for installing the memorial foundation system in which at least three support rods are driven into the ground within a trench.

The steps for installation of memorial markers 18 in a cemetery or other landscape with the memorial foundation system 20 include first excavating a trench 100 as shown in FIG. 7. The trench 100 has a width $W_{100}$ (FIGS. 8-10) slightly larger than the width W of the blocks 28. The trench 100 can have a length corresponding to the total number of blocks 28 and memorial markers 18 to be installed in a given row. Installation of one block 28 via two support assemblies 24 is described in detail, with the understanding that additional blocks 28 are installed similarly. Two vertical supports 36 are driven into the ground in spaced apart relationship within the trench 100 (e.g., by rotation to screw the screw portion 40 into the ground). The spacing distance between the vertical supports 36 generally corresponds to the length L of the block 28.

Figure 8:
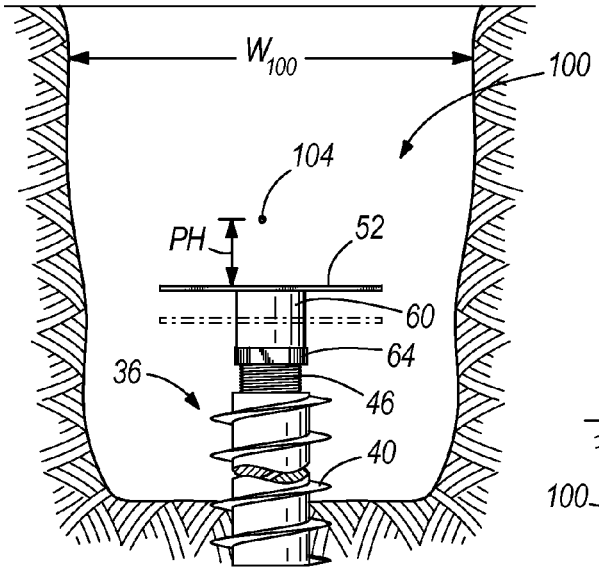
FIG. 8 illustrates a method step for installing the memorial foundation system in which an adjustable support plate is screwed onto each support rod and adjusted to a common height.

A support plate 52 is coupled to upper end 48 of each of the first and second vertical supports 36 as shown in FIG. 8. For example, the threaded first and second attachment structures 46, 60 are screwed together. The support plates 52 can be leveled with each other atop the first and second vertical supports 36. This reduces the need to finely adjust the vertical supports 36 when initially installed. Leveling the support plates 52 includes threading at least one of the support plates 52 up or down on the threaded head portion at the upper end 48 of the corresponding vertical support 36. A height guide separate from the principle elements of the memorial foundation system 20 may be set up to provide a reference datum for height adjustment. For example, the support plates 52 may be adjusted to achieve a predetermined height PH relative to a string line 104 deployed (e.g., pulled level and taut) across the trench 100. When the desired height of the support plates 52 is achieved, the locking device (the jam nut 64 in the illustrated construction) is locked to secure the height of the support plate 52 on the vertical support 36. With uniform height among the support plates 52, attention is turned to horizontal alignment.

Figure 9:
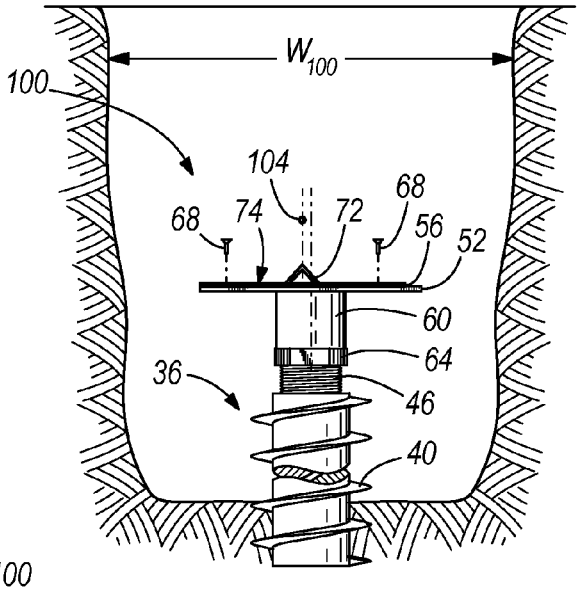
FIG. 9 illustrates a method step for installing the memorial foundation system in which respective alignment plates, laterally aligned with each other, are placed onto the support plates.
Figure 10:
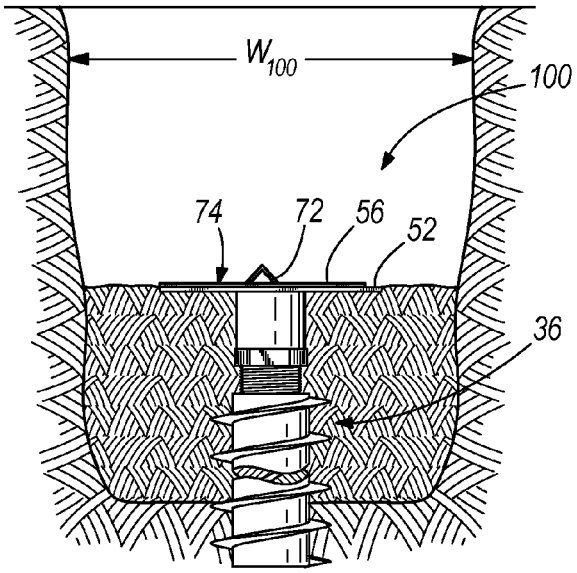
FIG. 10 illustrates a method step for installing the memorial foundation system in which the trench is back-filled to a height just below a top of the alignment plates.
Figure 11:
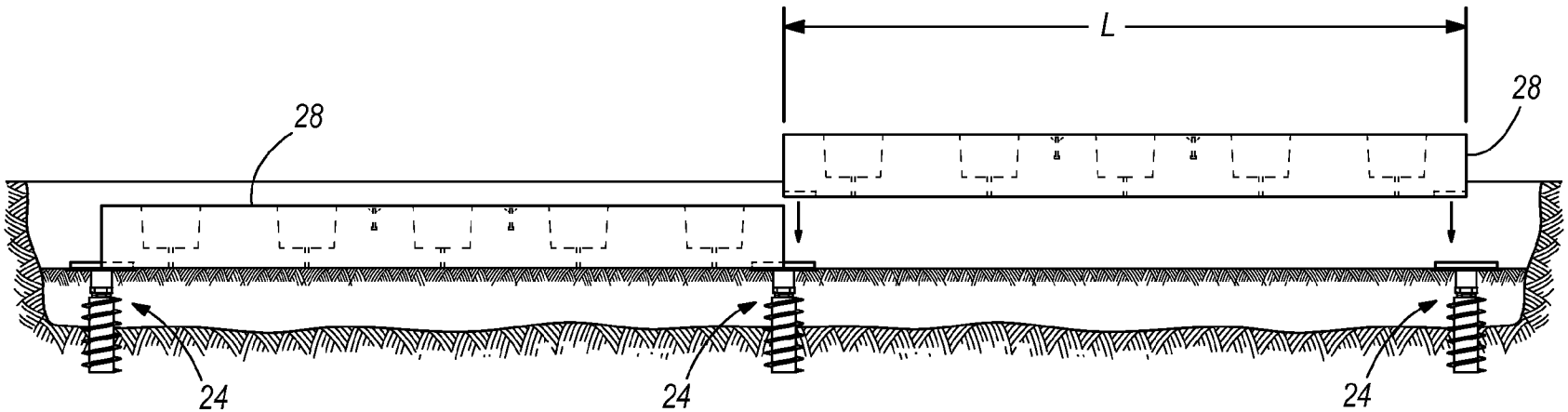
FIG. 11 illustrates a method step for installing the memorial foundation system in which blocks are placed on the supports.

As shown in FIG. 9, an alignment plate 56 is secured to each of the support plates 52 such that the respective engagement structures 72 provided on the upper surfaces 74 of the alignment plates 56 are aligned with each other, irrespective of misalignment between the various support plates 52. The alignment plates 56 can be aligned with each other in the lateral direction by aligning the engagement structure 72 of each alignment plate 56 with the string line 104, which can be set up as a centerline guide in addition to a height datum. When the alignment plates 56 are secured to the support plates 52, the trench 100 is partially back-filled (e.g., with dirt and/or stone) as shown in FIG. 10 to a height up to or just short of the height of the alignment plates 56. As shown in FIG. 11, each block 28 is then placed onto a pair of adjacent alignment plates 56 such that the vertical support assemblies 24 provide a level base for the block 28, and the complementary engagement structures 72, 76 secure the lateral position of the block 28. When numerous blocks 28 are installed in an extended end-to-end row, each alignment plate 56 supports on its first half an end of a first block 28 and on its second half, an end of a second adjacent block 28.

Figure 12:
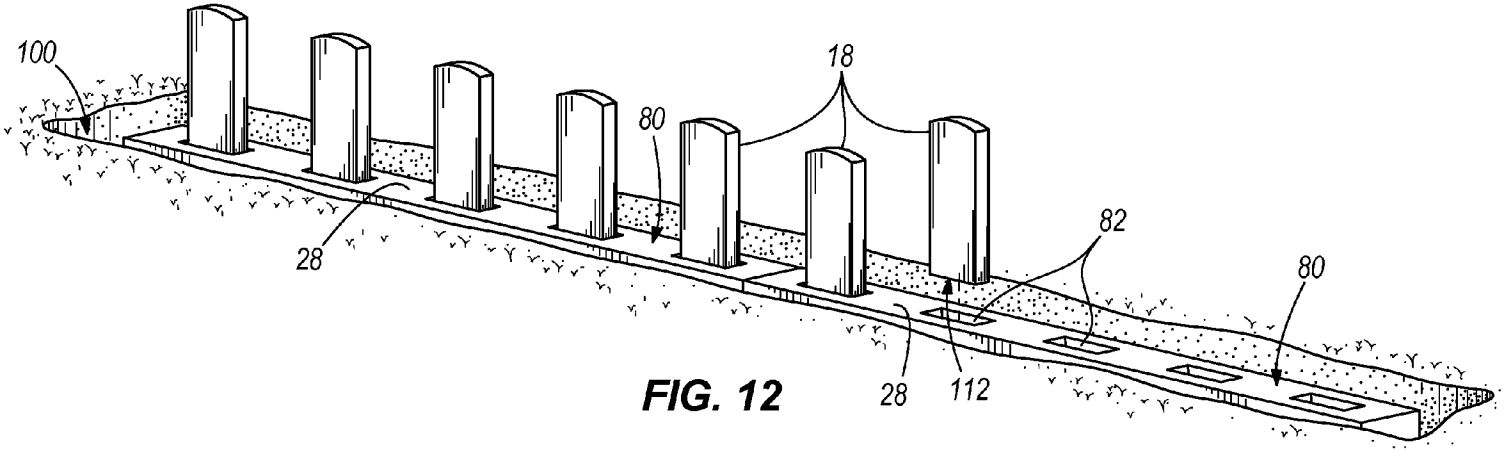
FIG. 12 illustrates a method step for installing the memorial foundation system in which memorial markers are inserted into pockets formed in the blocks.
Figure 13:
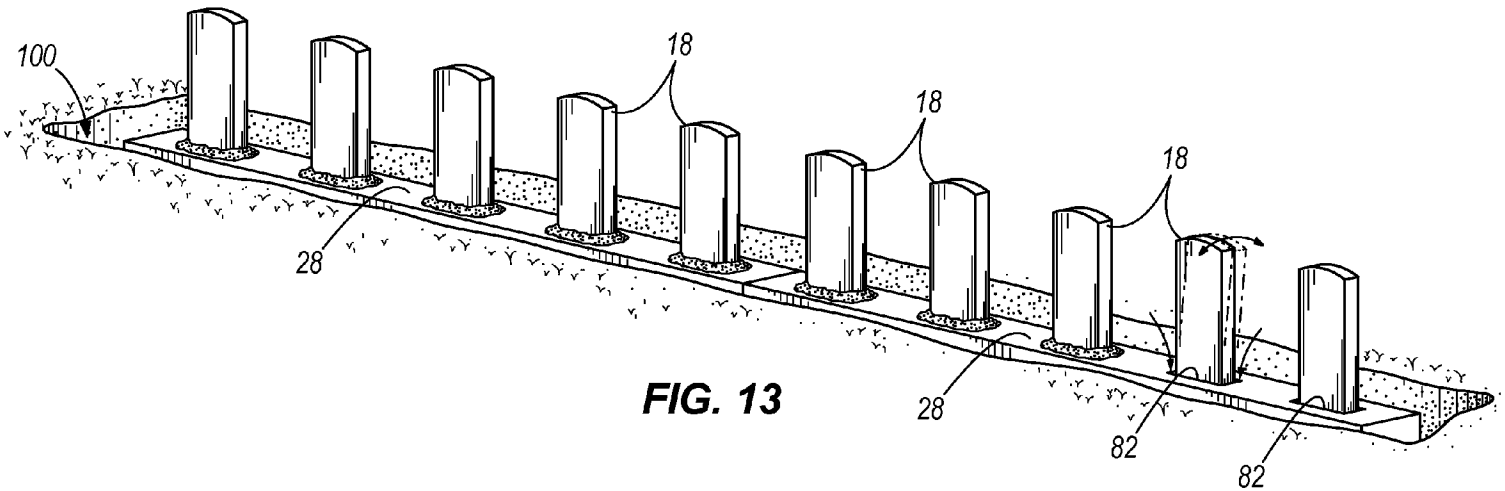
FIG. 13 illustrates a method step for installing the memorial foundation system in which the individual pockets are back-filled around the memorial markers, preventing fore-aft tilt.
Figure 14:
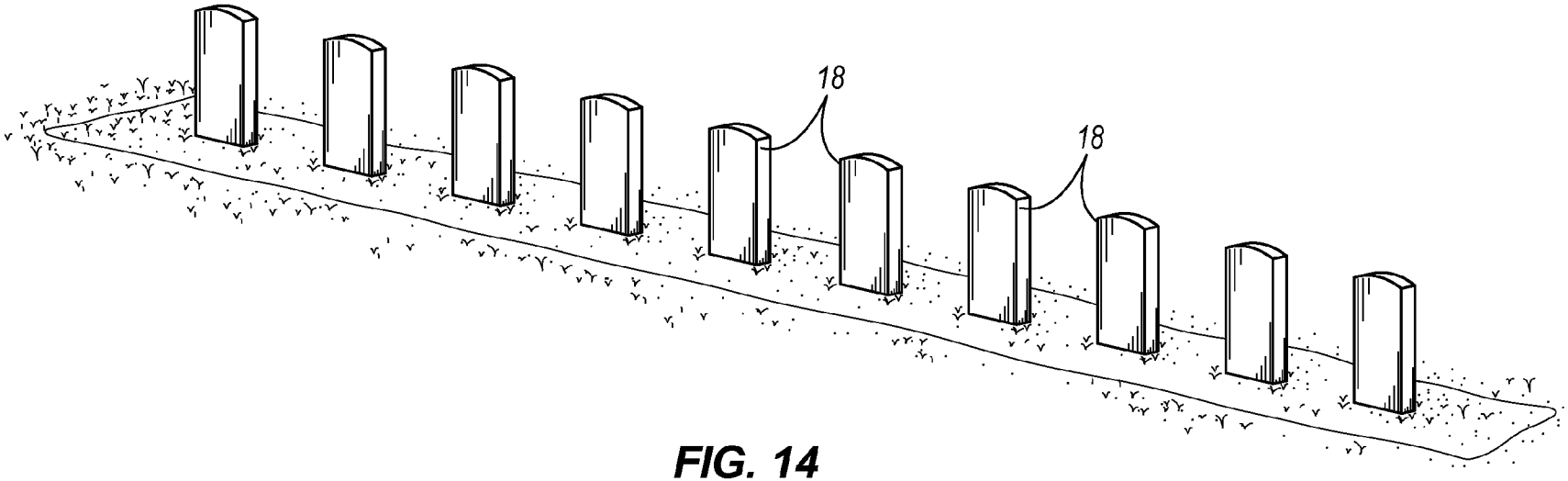
FIG. 14 illustrates a method step for installing the memorial foundation system in which the trench is back-filled to cover the blocks.

A memorial marker 18 is installed into each of the plurality of pockets 82 of the one or more blocks 28 (FIG. 12) such that a bottom surface 112 of each memorial marker 18 rests on the bottom surface 86 of the corresponding pocket 82 to form an aligned row of memorial markers 18 of even height. The memorial markers 18 are positioned plumb, and the individual pockets 82 are back-filled (e.g., with traffic bond, locking sand, etc.) around the memorial markers 18 and compacted to prevent fore-aft tilt (FIG. 13). Dirt and/or sod are then placed over the block(s) 28 to fill in the trench 100 up to ground level as shown in FIG. 14. The system and installation process, or parts thereof, may be utilized for new installations or for re-setting existing memorial markers 18, in which case the memorial markers 18 are first removed from their existing setting, catalogued, and set aside while the new foundation is installed.

Various features and advantages of the invention are set forth in the following claims.

What is claimed is:

1. A memorial foundation system comprising:

a pair of vertical supports, each having a screw thread on at least a portion extending from a bottom end thereof, each of the pair of vertical supports further having a head portion with a first attachment structure at an upper end;

a pair of support plates corresponding to the pair of vertical supports, each of the pair of support plates having a second attachment structure configured to mate with the first attachment structure;

a first block having a first end supported by one of the pair of support plates and one of the pair of vertical supports and a second opposite end supported by the other of the pair of support plates and the other of the pair of vertical supports, the first block including a plurality of pockets arranged in a row, each of the plurality of pockets being open to an upper side of the first block; and a first plurality of markers, each of which is configured to be received by a corresponding one of the plurality of pockets in the block to arrange the first plurality of markers in an aligned row with even height.

2. The memorial foundation system of claim 1, wherein the first attachment structure and the second attachment structure are mated with a height-adjustable interface.

3. The memorial foundation system of claim 2, wherein the height-adjustable interface includes threads formed on the head portion of the respective vertical support and a threaded extension secured to and extending from a bottom surface of the respective support plate.

4. The memorial foundation system of claim 1, further comprising a pair of alignment plates, each of the pair of alignment plates being securable to a corresponding one of the pair of support plates and having an engagement structure provided on an upper surface thereof that is engageable with a complementary engagement structure provided on a bottom surface of the block.

5. The memorial foundation system of claim 4, wherein the engagement structures of the alignment plates and the complementary structure of the block are a V-shaped projection and a complementary V-shaped notch.

6. The memorial foundation system of claim 1, further comprising:

a third vertical support arranged in a row with the pair of vertical supports;

a third support plate configured to mate with the third vertical support;

a second block having a first end supported by one of the pair of support plates and one of the pair of vertical supports and a second opposite end supported by the third support plate and the third vertical support, the second block including a plurality of pockets arranged in a row, each of the plurality of pockets being open to an upper side of the second block; and a second plurality of markers, each of which is configured to be received by a corresponding one of the plurality of pockets in the second block to arrange the second plurality of markers in a row aligned with the first plurality of markers and at an even height with the first plurality of markers.

7. The memorial foundation system of claim 6, further comprising an alignment plate coupled to the one of the pair of support plates that supports the second end of the first block and the first end of the second block, wherein each of the first and second blocks includes an engagement structure engageable with a complementary engagement structure of the alignment plate to align the first and second blocks.

8. The memorial foundation system of claim 7, further comprising two additional alignment plates respectively coupled to the third support plate and the one of the pair of support plates that supports the first end of the first block, wherein each of the two additional support plates includes an engagement structure aligned with the engagement structure of the alignment plate engaging the second end of the first block and the first end of the second block.

9. A memorial foundation system comprising:

first, second, and third supports, each having a screw thread on at least a portion extending from a bottom end thereof for driving into the ground and further having at least one plate positioned at an upper end thereof;

first and second blocks, each having a plurality of pockets arranged in a row, each of the plurality of pockets being open to an upper side of the respective block, wherein the first block is supported by the first and second supports, and the second block is supported by the second and third supports, wherein a bottom surface of each of the first and second blocks and a top surface of the at least one plate of the second support are provided with interlocking engagement structures to align the first and second blocks; and a plurality of markers, each of which is configured to be received by a corresponding one of the plurality of pockets of the first and second blocks to arrange the plurality of markers in both the first and second blocks in an aligned row with even height.

10. The memorial foundation system of claim 9, wherein the interlocking engagement structures include a V-shaped projection and a V-shaped notch.

11. The memorial foundation system of claim 9, wherein each of the first, second, and third supports includes a vertical support rod having the screw thread, and the at least one plate includes a support plate coupled to the vertical support rod and an alignment plate coupled to the support plate and having the interlocking engagement structure.

12. The memorial foundation system of claim 11, wherein the support plate of each of the first, second, and third supports is coupled to the respective vertical support rod with a height-adjustable interface.

13. The memorial foundation system of claim 12, wherein the height-adjustable interface includes threads formed on the upper portion of the respective vertical support rod and a threaded extension secured to and extending from a bottom surface of the respective support plate.

14. A method of installing a memorial foundation system, the method comprising:

forming a trench in the ground;

driving first and second spaced apart vertical support rods into the ground within the trench;

providing at least one plate atop the first vertical support rod, the at least one plate arranged to present a first upwardly-facing engagement structure;

providing at least one plate atop the second vertical support rod, the at least one plate arranged to present a second upwardly-facing engagement structure;

aligning the first and second engagement structures;

providing a first block having a plurality of pockets arranged in a row, each of the plurality of pockets being open to an upper side of the first block;

placing the first block onto the at least one plate on the first vertical support rod and onto the at least one plate on the second vertical support rod such that at least one complementary engagement structure provided on a bottom surface of the first block engages the first and second engagement structures; and installing a plurality of markers into corresponding ones of the plurality of pockets in the first block to form an aligned row of even height.

15. The method of claim 14, further comprising leveling the at least one plate atop the first vertical support rod with the at least one plate atop the second vertical support rod prior to placing the first block.

16. The method of claim 15, wherein leveling the at least one plate includes threading the at least one plate up or down on a threaded head portion of the corresponding vertical support rod.

17. The method of claim 15, wherein leveling the at least one plate includes adjusting the at least one plate to achieve a predetermined height relative to a string line pulled across the trench.

18. The method of claim 14, further comprising driving a third vertical support rod into the ground within the trench on a side of the second vertical support rod that is opposite the first vertical support rod;

providing at least one plate atop the third vertical support rod, the at least one plate arranged to present a third upwardly-facing engagement structure;

aligning the third engagement structure with the first and second engagement structures;

providing a second block having a plurality of pockets arranged in a row, each of the plurality of pockets being open to an upper side of the second block;

placing the second block onto the at least one plate on the second vertical support rod and onto the at least one plate on the third vertical support rod such that a complementary engagement structure provided on a bottom surface of the second block engages the second and third engagement structures; and installing a plurality of markers into corresponding ones of the plurality of pockets in the second block to arrange the plurality of markers in both the first and second blocks in an aligned row with even height.

19. The method of claim 14, wherein providing the at least one plate atop the first vertical support rod includes providing a first support plate height-adjustably coupled to the first vertical support rod, and providing a first alignment plate having the first engagement feature thereon, and wherein providing the at least one plate atop the second vertical support rod includes providing a second support plate height-adjustably coupled to the second vertical support rod, and providing a second alignment plate provided with the second engagement feature thereon.

20. The method of claim 19, wherein aligning the first and second engagement structures includes aligning the first and second alignment plates with a string line pulled across the trench, the method further comprising securing the first and second alignment plates to the respective first and second support plates with a plurality of fasteners.

* * * * *